US009321589B2

(12) United States Patent
Elliott et al.

(10) Patent No.: US 9,321,589 B2
(45) Date of Patent: Apr. 26, 2016

(54) DISCHARGING PARTICULATE MATERIALS FROM STORAGE SILOS

(75) Inventors: Marc G. Elliott, Longwood, FL (US); Vitto A. Cavallaro, Orlando, FL (US); Joseph T. Mollick, Longwood, FL (US)

(73) Assignee: GENCOR INDUSTRIES, INC., Orlando, FL (US)

( * ) Notice: Subject to any disclaimer, the term of this patent is extended or adjusted under 35 U.S.C. 154(b) by 176 days.

(21) Appl. No.: 14/004,554

(22) PCT Filed: Mar. 12, 2012

(86) PCT No.: PCT/US2012/028777

§ 371 (c)(1), (2), (4) Date: Sep. 11, 2013

(87) PCT Pub. No.: WO2012/125565

PCT Pub. Date: Sep. 20, 2012

(65) Prior Publication Data

US 2014/0010620 A1 Jan. 9, 2014

Related U.S. Application Data

(60) Provisional application No. 61/451,631, filed on Mar. 11, 2011.

(51) Int. Cl.

| | |
|---|---|
| ***B65D 90/62*** | (2006.01) |
| ***B65D 88/28*** | (2006.01) |
| ***B65D 90/58*** | (2006.01) |
| ***B65D 83/06*** | (2006.01) |
| *B65D 88/74* | (2006.01) |

(52) U.S. Cl.

CPC ..... *B65D 90/623* (2013.01); *B65D 83/06* (2013.01); *B65D 88/28* (2013.01); *B65D 90/582* (2013.01); *B65D 90/587* (2013.01); *B65D 88/744* (2013.01); *B65D 2590/542* (2013.01)

(58) Field of Classification Search

CPC ..... B65D 88/28; B65D 88/32; B65D 88/48; B65D 88/54; B65D 90/623; B65D 90/64; B65G 63/067; B65G 65/32; B01J 8/003; B65B 3/003; E04H 7/22

See application file for complete search history.

(56) References Cited

U.S. PATENT DOCUMENTS 1,087,343 A * 2/1914 Abbot ..... 294/68.24
1,850,589 A * 3/1932 Le Tourneau ..... 222/502

(Continued)

FOREIGN PATENT DOCUMENTS

DE 90 15 828 2/1991
EP 2 062 832 5/2009

(Continued)

OTHER PUBLICATIONS

Extended European Search Report dated Apr. 30, 2015 issued in European Patent Application No. 12757355.8, 6 pp.

*Primary Examiner* — Glenn Myers
(74) *Attorney, Agent, or Firm* — Nixon & Vanderhye P.C.

(57) ABSTRACT

A storage and discharge apparatus for particulate material includes a silo and a dispensing cone adjacent a lower end of the silo. The dispensing cone is formed in a partial conical shape and includes a fill portion oriented to face the lower end of the silo at a base end of the conical shape and a dispense portion at an apex end of the conical shape. The dispense portion includes extension sections that extend longitudinally outward from the apex end of the conical shape.

14 Claims, 4 Drawing Sheets

(56) References Cited

U.S. PATENT DOCUMENTS

| | | | | | |
|---|---|---|---|---|---|
| 2,856,223 | A | * | 10/1958 | Weaver | 294/68.24 |
| 3,304,065 | A | * | 2/1967 | Eaton | 366/18 |
| 3,802,582 | A | | 4/1974 | Brock | |
| 3,917,091 | A | * | 11/1975 | Herold | B65G 47/72 414/808 |
| 3,946,909 | A | * | 3/1976 | Wheeler | 222/556 |
| 6,485,029 | B1 | * | 11/2002 | Moody et al. | 277/642 |
| 7,513,280 | B2 | | 4/2009 | Brashears et al. | |

FOREIGN PATENT DOCUMENTS

| | | |
|---|---|---|
| JP | 56-175394 | 12/1981 |
| JP | 6-53499 | 7/1994 |

* cited by examiner

DISCHARGING PARTICULATE MATERIALS FROM STORAGE SILOS

This application is the U.S. national phase of International Application No. PCT/US2012/028777 filed 12 Mar. 2012 which designated the U.S. and claims priority to U.S. Provisional Patent Application No. 61/451,631 filed 11 Mar. 2011, the entire contents of each of which are hereby incorporated by reference.

BACKGROUND OF THE INVENTION

The present invention relates to a silo for storing particulate material, e.g., but not limited to, hot asphaltic mix, aggregates, cement and concrete mixtures and particularly relates to a storage and discharge system for discharging the material from the silo into trucks.

Silos for receiving, storing and discharging particulate materials, for example, hot asphaltic mix, are typically employed before delivery of the materials to an end user for a number of different reasons. Batch asphalt plants utilize storage silos for temporarily storing the asphaltic mix, and this enables the plant to run at a more consistent rate, which effectively improves plant productivity. For drum mix plants where the product, e.g., hot asphalt mix, is made continuously, silos effectively provide for additional surge capacity. Thus, silos enable the drum mix plant to operate continuously to produce the asphaltic mix while trucks deliver the asphaltic mix on a batch basis. Additionally, multiple silos are used to make available different types of mixes without having to switch mix designs on the production units. Also, since a mix is already made and can be dispensed as needed from a silo, trucks can be loaded with the asphaltic mix from the silo much faster for delivery to the end user and can increase the production capability of a particular plant. Further, silos enable the storage of the material for limited periods of time such as overnight so that the mix will be available early in the morning.

Storage silos, however, introduce several problems between the production of the mix and its delivery to an end user. Segregation of the mix, i.e., separation of larger aggregate from smaller aggregate in the mix, can occur in the silo due to flow differences between different sized aggregates. This may result in providing an end user with a non-uniform mix. Further, current single outlet silos may produce tunneling, i.e., "rat holing," of the mix flowing through the silo. That is, the material in the center of the silo may discharge along with the material above it leaving the material closer to the outer walls stagnant. This can contribute to the problem of segregation as well as other problems. Also, when storing asphaltic mix in a silo, oxygen can migrate into the silo and oxidize the mix creating hardened aggregate chunks, which will plug the silo and/or cause quality issues when using the asphaltic mix in a paving operation.

The problem of segregation of the aggregate is also influenced by the speed in which each truck is loaded with mix from the silo. For example, when a truck is located in the loading area under the silo with a single discharge outlet, and not moved during loading, the discharge provides a mix sensitive to segregation. That is, larger stones may roll to the front, to the rear and to each side of the truck leaving coarse material about the periphery of the pile and a fine mix in the middle of the pile loaded onto the truck bed. This coarse material then is the first and last material to be discharged from the truck bed. The coarse material may then be trapped in the wings of the paver resulting in coarse areas of pavement between each load. To prevent this type of segregation during loading, it is common practice in current single outlet silos to provide three separate discharges from the silo into each truck. For example, the first discharge may be made directly adjacent the front of the truck bed, the second discharge directly adjacent the tailgate and the third discharge in the center. By using this method, coarse material is forced to roll to the middle of the truck bed and then is covered up by the last discharge, thereby rendering greater uniformity of the aggregate material when discharged from the truck. These discrete steps and movements of the truck, however, slow the loading process although they provide some assurance that the load dumped from the truck will be substantially uniform with the coarse material intermixed. Thus, there has developed a need for a system for discharging particulate material from storage silos that will avoid the foregoing and other problems associated with prior silo discharge systems.

SUMMARY OF THE INVENTION

The storage and discharge apparatus of the preferred embodiments is designed to store and dispense particulate material into large and small trucks with only one opening of the silo gates filling the truck bed boxes in seconds. The silo dual dispensing gates open with the direction of truck travel under the silo filling the truck bed uniformly and evenly from one end to the other. A dispensing cone includes vertical possibly rounded ends and allows the material to drop and flow to the dispensing gates quickly filling the truck bed with material as the gates are opened and closed with no particle segregation.

In an exemplary embodiment, a storage and discharge apparatus for particulate material includes a silo and a dispensing cone adjacent a lower end of the silo. The dispensing cone is formed in a partial conical shape and includes a fill portion oriented to face the lower end of the silo at a base end of the conical shape and a dispense portion at an apex end of the conical shape. The dispense portion includes extension sections that extend longitudinally outward from the apex end of the conical shape. In one arrangement, the extension sections span a length of the dispense portion to an opening at a bottom end of the dispensing cone. A size of the opening preferably substantially corresponds to a cross-section through the extension sections. The extension sections and the opening may define an oblong or elliptical shape.

The storage and discharge apparatus may additionally include a dispensing gate that selectively opens and closes the opening at the bottom end of the dispensing cone. The dispensing gate may have opposing gate doors that open outward and close inward. Actuating devices may control a position of each of the gate doors, respectively, where the position of each of the gate doors is independently controllable. In one arrangement, the opposing gate doors each includes an elongate arcuate member connected to the actuating device and to a pivot.

The storage and discharge apparatus may still further include a gate sealing system for the dispensing gate that has a liquid circuit delivering a sealing liquid to concave surfaces of the opposing gate door elongate arcuate members.

In another exemplary embodiment, a method for storing and discharging particulate material from a silo includes the steps of providing a silo that defines a storage space for storing the particulate material, and providing a dispensing cone adjacent a lower end of the silo in direct communication with the storage space. The dispensing cone may be formed in a partial conical shape and may include a fill portion oriented to face the lower end of the silo at a base end of the conical shape and a dispense portion at an apex end of the conical shape. The dispense portion includes extension sections that extend longitudinally outward from the apex end of the conical shape. The method additional includes the steps of providing a generally rectilinear truck loading area below the silo and the dispensing cone, and opening the dispensing cone to discharge the particulate material from the silo and dispensing cone into a truck bed disposed in the loading area.

The truck has a generally rectilinear truck bed, and the method may further include a step of orienting the truck in the loading area with a length direction of the truck bed parallel to a length direction of the rectilinear loading area and parallel to a length direction of the dispense portion of the dispensing cone. The extension sections preferably span a length of the dispense portion to an opening at a bottom end of the dispensing cone, and the dispense portion includes a dispensing gate that selectively opens and closes the opening at the bottom end of the dispensing cone. The dispensing gate has opposing gate doors that open outward and close inward, where the gate doors are defined by elongate arcuate members with upwardly directed concave surfaces facing the opening. In this context, the method may further include a step of supplying a sealing fluid to the concave surfaces to seal the mix from the atmosphere in the region of the opening. The gate doors may also be defined as a flat or convex gate surface without a fluid sealing method.

The method may additionally include independently controlling respective positions of the gate doors.

BRIEF DESCRIPTION OF THE DRAWINGS

These and other aspects and advantages will be described in detail with reference to the accompanying drawings, in which.

DETAILED DESCRIPTION OF THE DRAWINGS

Figure 2:
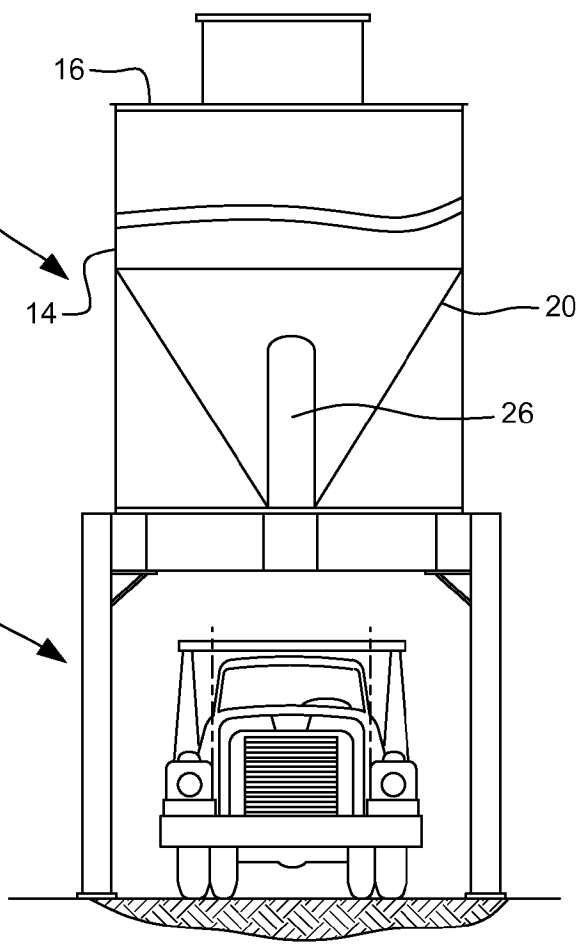
FIG. 2 is a front elevational view thereof.
Figure 1:
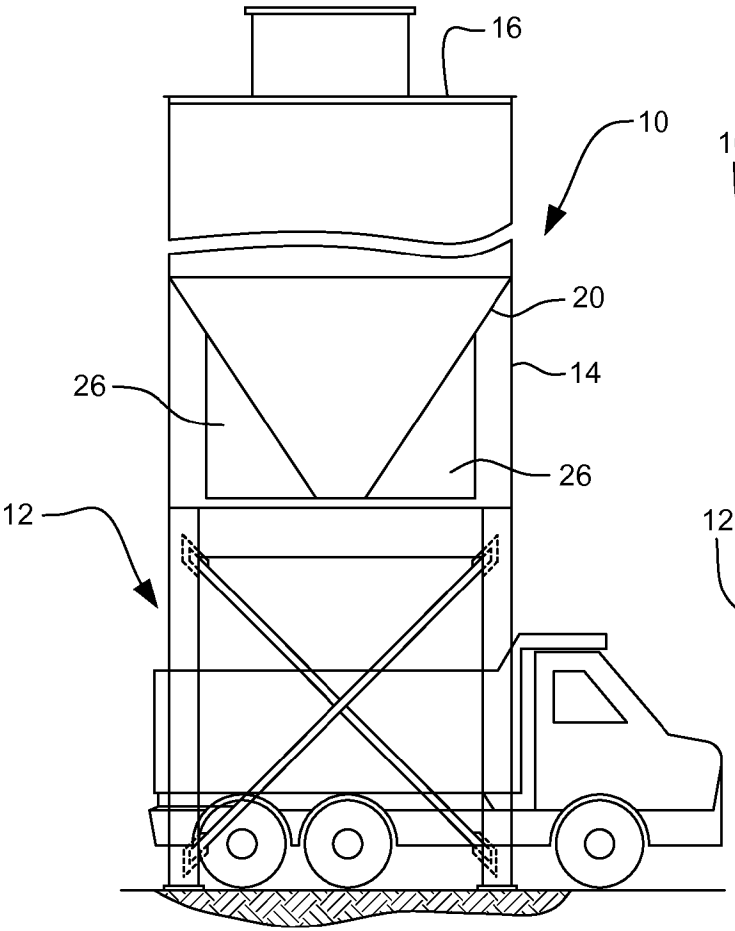
FIG. 1 is a side elevational view of a silo for discharging particulate material into a truck bed in a loading area below the silo.

Referring to FIGS. 1 and 2, there is illustrated a silo 10 for receiving, storing and discharging particulate material, e.g., asphaltic cement, aggregate materials, or mix, with a discharge opening elevated above a truck loading area 12. The silo 10 includes a generally cylindrical housing 14 having an upper section 16 on which is mounted one or more batcher hoppers (not shown) for feeding particulate material into the silo 10. Batcher hoppers are conventional in the prior art. The particulate material is fed by conveyors from a batch or drum mix plant and loaded through the batcher hoppers into the silo 10.

Figure 3:
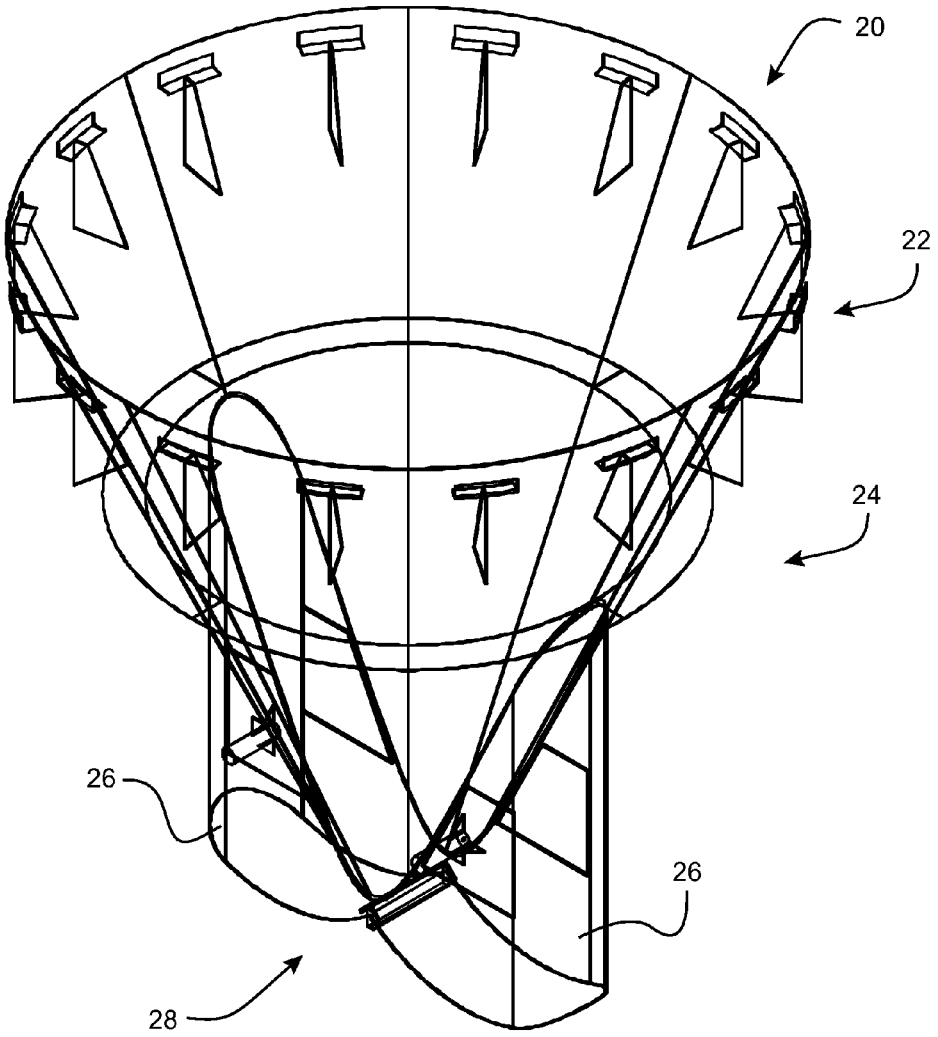
FIG. 3 is a perspective view of the dispensing cone.

FIG. 3 is a perspective view of a dispensing cone 20. The dispensing cone 20 is positioned adjacent a lower end of the silo 10. As shown, the dispensing cone 20 is formed in a partial conical shape and includes a fill portion 22 oriented to face the lower end of the silo 10 at a base end of the conical shape, and a dispense portion 24 at an apex end of the conical shape. The dispense portion 24 includes extension sections 26 that extend longitudinally outward from the apex end of the conical shape.

The extension sections 26 generally span a length of the dispense portion 24 to an opening 28 at a bottom end of the dispensing cone 20. A size of the opening 28 substantially corresponds to a cross section through the extension sections 26. In a preferred construction, the extension sections 26 and the opening 28 define an oblong or elliptical shape. A length of the opening 28 spans almost the entire length of a standard truck bed (see FIG. 1). The oblong opening 28 enables the truck bed to be filled uniformly and evenly from one end to the other. The particulate material drops from the silo through the opening 28 to quickly fill the truck bed with particulate material. By spanning substantially the entire length of the truck bed, the typical practice of jogging or reversing of trucks while on the scale can be eliminated. The dispensing cone 20 is steep-sided, which allows the particulate material to drop and flow quickly thereby filling the truck bed uniformly.

Figure 4:
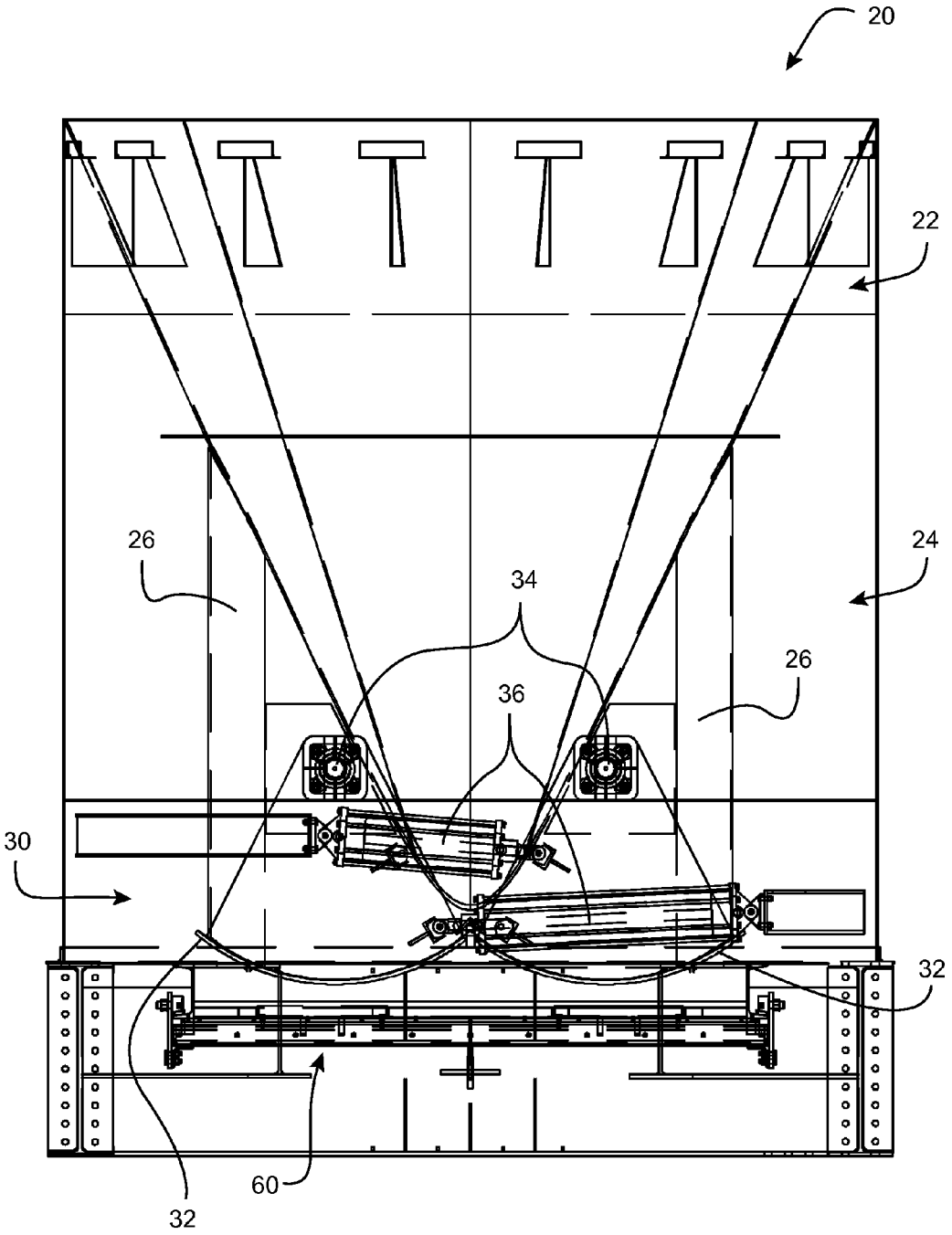
FIG. 4 is a side view of the dispensing cone and dispensing gate components.

With reference to FIG. 4, the opening 28 is opened and closed by a dispensing gate 30 at the bottom end of the dispensing cone 20. The dispensing gate 30 includes opposing gate doors 32 that open outward and close inward. As shown, the opposing gate doors 32 each comprise an elongate arcuate member. The gate doors may also be defined as a flat or convex gate surface. The gate doors 32 are secured to a pivot 34 and are displaced between opened and closed positions by respective actuating devices 36 or the like. The position of each of the gate doors 32 via the actuating devices 36 is independently controllable. The construction of the gate provides for a clean filling operation, where particulate material drops into the truck bed without being thrown onto the underlying scale surfaces, thereby improving overall load out efficiency. With the independently controllable gate doors 32, the dispensing gate 30 can be opened fully to fill large truck beds and can be partially opened for smaller truck beds. For the partial opening, the gates 32 can be controlled individually with only one gate opening or partially opening or with both gates partially opening or the like. Actuating device controls ensure accurate truck loading for all size truck capacities.

Figure 5:
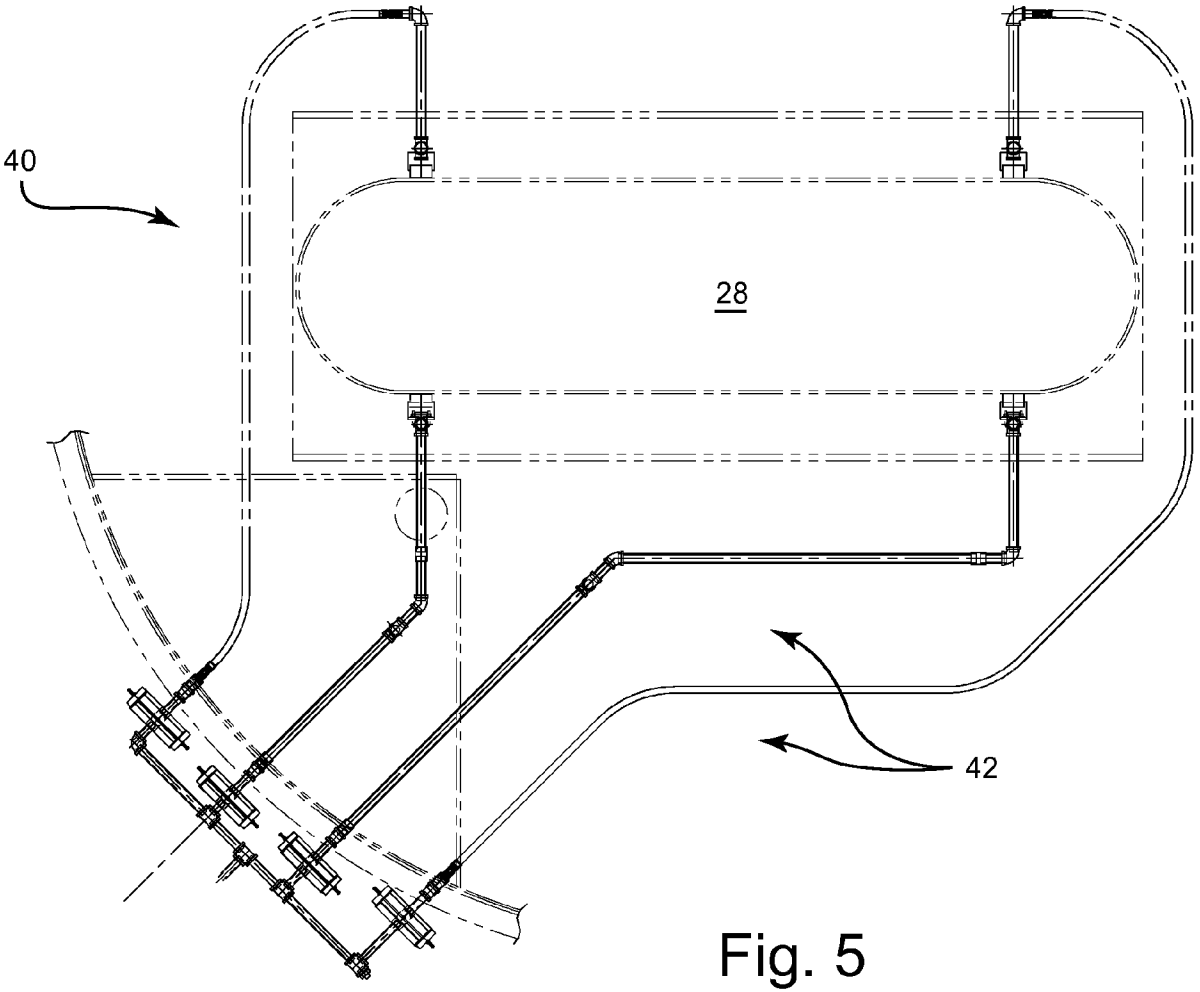
FIG. 5 is a schematic illustration of a gate sealing system for the dispensing gate.

It will be appreciated that when storing particulate material, e.g., asphaltic cement or concrete mix, oxidation of the mix may occur if oxygen is permitted to migrate into the silo. Oxidized mix creates hardened chunks of material which will plug the silo discharge openings and/or cause a quality problem when using the mix in a paving operation. Hot storage capabilities of the silo can be maintained using a main gate sealing system 40 to prevent oxidation and degradation as shown in FIG. 5. Generally, the gate sealing system 40 includes a liquid circuit 42 that delivers a sealing liquid, such as water or oil, from a tank to the concave surfaces of the elongate arcuate members of the opposing gate doors 32. The liquid seal serves to stop air infiltration. Sealing liquid is fed via a pump through the liquid circuit 42 to the gates 32. The liquid is pumped back to the tank using an automatic pump device when the silo is ready to dispense material. Another controlled pump may be located on a support leg of the silo at ground level to ease filling and adding sealing liquid to the storage tank from any type of container.

The concave surfaces enable the sealing liquid to be disposed on and carried by the gate members 32. That is, a liquid disposed on the concave gate members 32 would submerge the gap between the concave gate surface and the opening 28. The gate sealing system will thus seal any air containing oxygen away from the mix.

The silo 10 is also equipped with automatic back-up safety gates 60 (FIG. 4) located under the gate doors 32. The safety gates 60 close quickly on demand to stop the flow of particulate material if there are any emergency problems with the main dispensing gate 30. The safety gate 60 can be closed after each truck is loaded or closed in the hot storage mode as an additional seal. When the safety gate 60 is closed, the entire bottom dispensing area around the gates becomes completely closed and airtight via a suitable seal, holding the heat of the lower silo cone and eliminating air intrusion that could cause subsequent oxidation of the mix.

Particle size segregation is prevented while the silo is filled. As noted above, the mix is conveyed to a known anti-segregation batcher unit mounted to the top of the silo roof (not shown). The batcher gates operate quickly and automatically to batch feed the silo with homogeneous slugs of mix preventing particle separation or segregation of aggregate particle size. Material storage is improved by adding an optional batcher gate sealing system and batcher gate locks to hold the gates closed when the silo is in the storage mode. Sealing the batcher gates with these options prevents air from entering the system that can cause oxidation to the surface of the mix in the silo.

Preferably, the cylindrical body of the silo 10 is fully insulated as well as the roof. The floor area is sealed around the dispensing cone and is fully insulated as well to hold and maintain the heat needed at the silo discharge to ensure the flow of mix. The dispensing cone 20 can be heated electrically or by use of hot thermal fluid to maintain heat loss and ensure longer storage capabilities of the system. Insulated pad heaters may cover the entire surface of the gate doors 32 to ensure uniform gate heating and to ensure the flow of mix as it is dispensed.

With the storage and discharge apparatus of the preferred embodiments, material can be dropped directly into a truck bed for improved overall load-out efficiency without segregation. The load fills evenly across the entire truck bed in one drop so a typical 25 ton truck can be completely loaded in less than 10 seconds. Additionally, the dispensing cone design draws mix across the entire bottom of the silo evenly and smoothly, virtually eliminating the hourglass effect and segregation, creating more usable storage volume and more even flow. The result is improved quality and consistency in the mix, without the need to re-handle or re-mix.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A storage and discharge apparatus for particulate material comprising:

a silo; and a dispensing cone adjacent a lower end of the silo, the dispensing cone formed in a partial conical shape and including a fill portion oriented to face the lower end of the silo at a base end of the conical shape and a dispense portion below the fill portion and above an apex end of the partial conical shape, wherein the dispense portion includes extension sections that extend longitudinally outward from a position between the base end and the apex end of the partial conical shape to the apex end of the partial conical shape and that expand an interior volume of the dispensing cone, wherein the extension sections span a length of the dispense portion to an opening at a bottom end of the dispensing cone.

2. The storage and discharge apparatus according to claim 1, wherein a size of the opening substantially corresponds to a cross-section through the extension sections.

3. The storage and discharge apparatus according to claim 1, wherein the extension sections and the opening define an oblong or elliptical shape.

4. The storage and discharge apparatus according to claim 1, further comprising a dispensing gate that selectively opens and closes the opening at the bottom end of the dispensing cone.

5. The storage and discharge apparatus according to claim 4, wherein the dispensing gate comprises opposing gate doors that open outward and close inward.

6. The storage and discharge apparatus according to claim 5, further comprising actuating devices that control a position of each of the gate doors, respectively, wherein the position of each of the gate doors is independently controllable.

7. The storage and discharge apparatus according to claim 6, wherein the opposing gate doors each comprises an elongate arcuate member connected to the actuating device and to a pivot.

8. The storage and discharge apparatus according to claim 7, further comprising a gate sealing system for the dispensing gate, the gate sealing system including a liquid circuit that delivers a sealing liquid to concave surfaces of the opposing gate door elongate arcuate members.

9. The storage and discharge apparatus according to claim 5, wherein the opposing gate doors are one of concave, flat or convex.

10. A method for storing and discharging particulate material from a silo, the method comprising:

providing a silo that defines a storage space for storing the particulate material;

providing a dispensing cone adjacent a lower end of the silo in direct communication with the storage space, the dispensing cone being formed in a partial conical shape and including a fill portion oriented to face the lower end of the silo at a base end of the partial conical shape and a dispense portion below the fill portion and above an apex end of the partial conical shape, wherein the dispense portion includes extension sections that extend longitudinally outward from a position between the base end and the apex end of the partial conical shape to the apex end of the partial conical shape and span the length of the dispense portion to an opening at a bottom end of the dispensing cone, the extension sections expanding an interior volume of the dispensing cone;

providing a generally rectilinear truck loading area below the silo and the dispensing cone; and opening the dispensing cone to discharge the particulate material from the silo and dispensing cone into a truck bed disposed in the loading area.

11. The method according to claim 10, wherein the truck has a generally rectilinear truck bed, and wherein the method further comprises orienting the truck in the loading area with a length direction of the truck bed parallel to a length direction of the rectilinear loading area and parallel to a length direction of the dispense portion of the dispensing cone.

12. The method according to claim 11, wherein the dispense portion includes a dispensing gate that selectively opens and closes the opening at the bottom end of the dispensing cone, the dispensing gate comprising opposing gate doors that open outward and close inward, wherein the gate doors comprise elongate arcuate members with upwardly directed concave surfaces facing the opening, the method further comprising supplying a sealing fluid to the concave surfaces to seal the particulate material from the atmosphere in the region of the opening.

13. The method according to claim 12, further comprising independently controlling respective positions of the gate doors.

14. The method according to claim 12, comprising providing the extension sections and the opening in an oblong or elliptical shape.

* * * * *